US006047741A

United States Patent [19]

Kurmis

[11] Patent Number: 6,047,741

[45] Date of Patent: Apr. 11, 2000

[54] TOOL FOR TYING ARTICLES, IN PARTICULAR CABLE HARNESSES

[76] Inventor: Viktor Kurmis, Rethwiese 34, 25421 Pinneberg, Germany

[21] Appl. No.: 09/038,550

[22] Filed: Mar. 11, 1998

[30] Foreign Application Priority Data

Mar. 11, 1997 [DE] Germany ..... 297 04 402 U

[51] Int. Cl.[7] ..... B21F 9/02

[52] U.S. Cl. ..... 140/93 A; 140/93.2

[58] Field of Search ..... 140/93 A, 93.2

[56] References Cited

U.S. PATENT DOCUMENTS

| | | | |
|---|---|---|---|
| 4,371,010 | 2/1983 | Hidassy | 140/93 A |
| 4,495,972 | 1/1985 | Walker | 140/93.2 |
| 4,640,319 | 2/1987 | Walker | 140/93 A |
| 5,205,328 | 4/1993 | Johnson et al. | 140/93.2 |

FOREIGN PATENT DOCUMENTS

| | | | |
|---|---|---|---|
| 0 035 367 A1 | 9/1981 | European Pat. Off. | B65B 13/02 |
| 0 261 697 B1 | 9/1984 | European Pat. Off. | B65B 13/02 |
| 82/02867 | 9/1982 | WIPO | 140/93 A |

*Primary Examiner*—Lowell A. Larson
*Attorney, Agent, or Firm*—Alix, Yale & Ristas, LLP

[57] ABSTRACT

A tool for tying articles, in particular cable harnesses, by means of tapes. The latter are fed to the tool in the form of a magazine strip (21) which contains the tapes alongside one another. Feeding takes place in a predetermined direction through a tool insertion opening (16) that accepts the end (22) of the magazine strip (21). According to the invention, the magazine can be attached to the tool (7) by means of guide devices (23, 24) which, at least in their part which determines the last part of the attaching movement, are designed such that the outlet opening of the magazine approaches the insertion opening (16) of the tool (7) approximately in the predetermined direction.

9 Claims, 3 Drawing Sheets

TOOL FOR TYING ARTICLES, IN PARTICULAR CABLE HARNESSES

FIELD OF THE INVENTION

The invention relates to a tool for tying articles, in particular cable harnesses

BACKGROUND OF THE INVENTION

Cable-tying tools to which the tapes to be used may be fed in the form of a magazine strip which contains the tapes alongside one another and connects them to one another are known. For this purpose, the tool has an insertion opening into which the magazine strip is inserted in a predetermined direction. The leading end of the magazine strip is then held by the tool, while its trailing end, which may contain a few dozen tapes, floats freely outside the tool. As work progresses, the magazine strip is gradually used up and then replaced by a further magazine strip. The limited number of tapes contained in one magazine strip is in many cases a definite drawback.

It is known to put the tapes into a magazine so that they are spatially separate from the tool and to feed them pneumatically to the tool, individually, through a hose that connects the magazine to the tool. This is complicated and makes the mobile use of the tool impossible.

SUMMARY OF THE INVENTION

The invention is therefore based on the object of providing an interchangeable magazine arrangement for the said tools which permits easy attachment of the magazine to the tool.

According to the present invention, the magazine strip is contained in a magazine that can be attached to the tool by means of guide devices. The guide devices, at least in their part which determines the last part of the attaching movement, are designed such that the outlet opening of the magazine approaches the insertion opening of the tool in approximately the predetermined direction in which the magazine strip is intended to be fed to the insertion opening. It is preferable if the end of the magazine tape that projects out of the outlet opening of the magazine is likewise located in the feed direction. The effect of this is that, when the magazine is being attached to the tool, the magazine tape passes automatically into the insertion opening of the tool, without the end of the magazine strip needing to be laboriously manipulated and positioned. This is true in particular when the magazine is a drum of circular cross section, from which the end of the magazine tape emerges approximately tangentially.

Attachment of the magazine to the tool takes place in a particularly straightforward manner when, for the connection, provision is made for a plug-in guide in which the cooperating surfaces of the drum and of the tool end in part-surfaces that extend approximately in the feed direction. This also applies when the plug-in guide otherwise extends essentially radially with respect to the drum. Said plug-in guide is then provided at its ends with cam surfaces that extend transversely thereto and, as a result, force that region of the drum that forms the outlet opening of the same to move in the tangential direction.

The precondition for trouble-free, functionally reliable attachment of the magazine to the tool is that the tool itself is ready to accept the strip end when the magazine is attached. For this purpose, provision is made in the tool for a transport member that forms a plurality of tape receptacles and is equipped with a device for the standby positioning of one each of its tape receptacles in a ready-to-feed position behind the insertion opening. This member may be, in particular, a roll, which carries the tape receptacles on the circumference and is arranged behind the insertion opening, approximately tangentially to the feed direction.

BRIEF DESCRIPTION OF THE DRAWINGS

The invention is explained in detail below with reference to the drawing, which illustrates an advantageous exemplary embodiment. In the drawing.

DESCRIPTION OF THE PREFERRED EMBODIMENT

Figure 1:
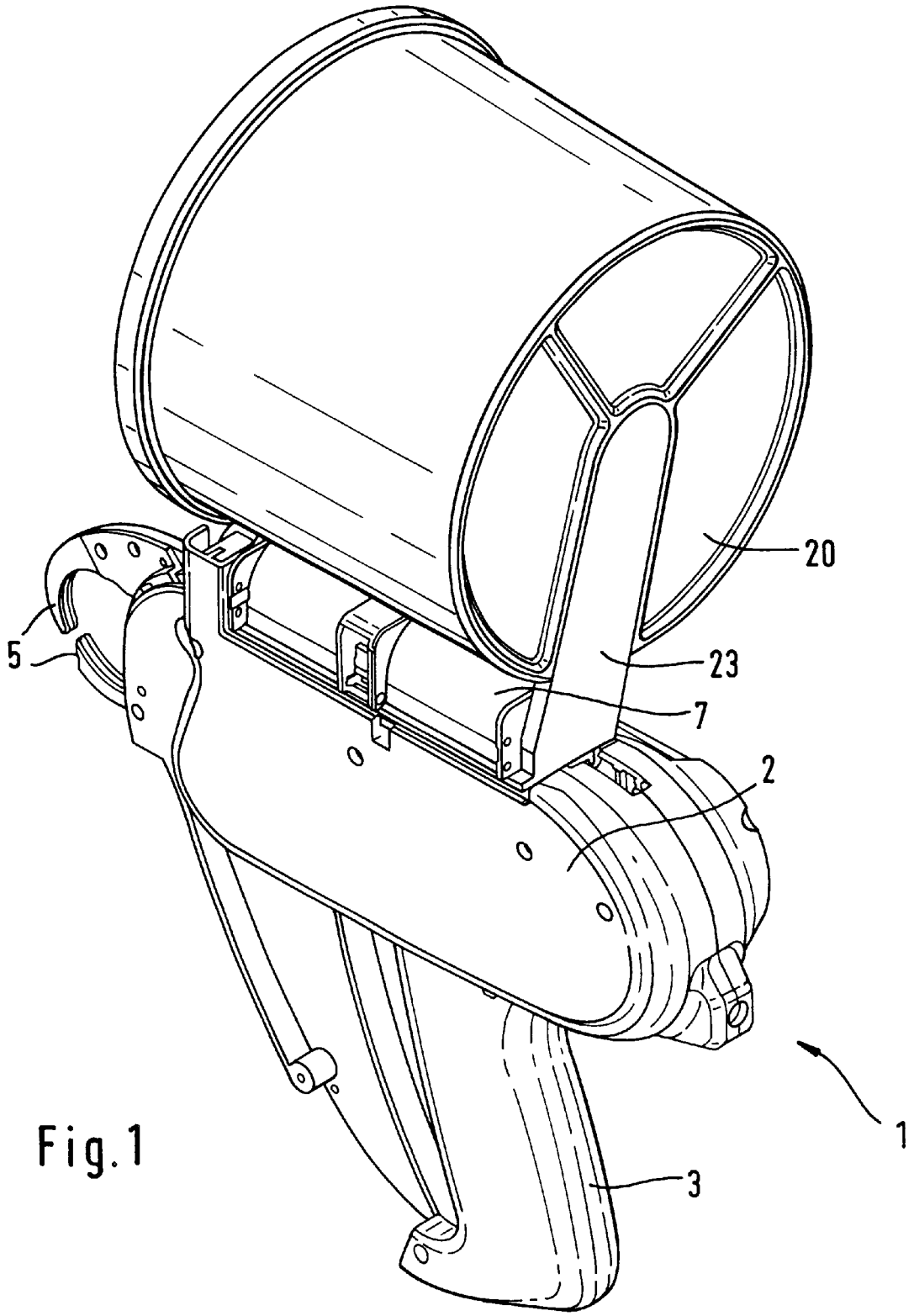
FIG. 1 shows the tool with magazine in a perspective illustration.

The tool 1 comprises an elongate tool body 2, which can be held in the manner of a pistol by means of a handle 3 and whose tying function is triggered by means of a manual switch. At the front end, the tool body carries wrapping tongs 5, which lead the respective tape around the article to be tied. Located inside the tool body 2 is a tape guide channel 6, which runs in the longitudinal direction of the tool body and in which a tape can be advanced to the wrapping tongs 5. Provided on the back of the tool body 2 is a pulling-in device 7, which contains a pulling-in drum 8 on whose circumference there are arranged at regular intervals a plurality of projections 9, between which there are recesses 10 which are intended for accepting of individual tapes which are held alongside one another within a magazine strip. The magazine strip may be of the type illustrated in EP-B 261 697.

By means of devices that are not illustrated, the pulling-in drum 8 can be driven stepwise, in the direction of arrow 11, in each case through an angular interval corresponding to the projections 9, the standby positions of said drum being placed such that in each case one recess 10 coincides with the advance channel 6. The recesses 10 are closed to the outside by housing parts or brackets 12, whose inner surface 13 follows a circular arc about the axis of the pulling-in drum 8 over approximately a semicircle which leads approximately from the upper vertex of the pulling-in drum 8 as far as the advance channel 6. The guide surface 13 holds the tapes, which have been inserted in the region of the vertex of the pulling-in drum 8, in the recesses 10 until they reach their destination, the advance channel 6.

The guide surface 13 ends in the region of the vertex of the pulling-in drum 8 or, projecting a little beyond this in the direction opposite to the advancement direction, in an edge 14. This edge, together with a housing edge 15 that is located opposite it on the circumference of the advance drum, bounds the insertion opening 16 for the magazine strip. The edge 15 is formed by a housing part 17 which, in the vicinity of the edge 15, extends approximately in the direction of a tangent to the core region of the pulling-in drum 8. The core region of the pulling-in drum 8 is formed by the sunken base of the recess 10 between the projections 9. The guide surface 13 extends, in the vicinity of the edge 14 formed by it, parallel to this direction, approximately tangentially to the outer bounding circle, formed by the tips of the projections 9, of the pulling-in drum 8. This direction corresponds approximately to the predetermined insertion direction 18, in which the magazine strip can run into the pulling-in drum tangentially to the greatest possible extent.

Connected to the tool is a magazine 20, in which there are contained, for example, a few hundred tapes in the form of a coherent, wound magazine strip, which is indicated schematically at 21 and whose end 22 emerges approximately tangentially from an opening at the circumference of the magazine.

The magazine is connected interchangeably to the tool by means of a plug-in connection which is formed, on the one hand, from two parallel struts 23 on the tool body which correspond in shape and, on the other hand, from a receptacle 24 of corresponding shape on the two ends of the magazine 20. The struts 23 and receptacles 24 cooperate with side surfaces 25, 26, 27, 28, which form a guide device, which determines the direction of movement of the magazine drum 20 when being attached to the tool. In relation to the drum, these surfaces extend essentially radially. In relation to the tool, they extend upward (when the handle is directed downward), and are inclined to the right just out of the view of the user. The magazine drum is therefore not seated centrally over the tool but rather is displaced slightly to the right, in order to give the user an easier view of the tying point.

The guide devices which have been described up to this point and can be seen in FIG. 1 result in a direction extending essentially from top to bottom for the movement of the magazine when it is being attached to the tool. This direction ends when, according to FIG. 3, the corner 29 of the guide surface 25 butts against a part-surface 30 which is angled to the left (in the drawing) at an obtuse angle and forces the corner to move obliquely to the left. On the opposite side, at a corresponding point, the guide surface 27 merges into a tab 31 that is directed to the left and to which a cutout 32 corresponds as a continuation of the guide surface 28 on the strut 23. The effect of these part-surfaces is that, during the further attaching movement, at least that region of the drum that comprises these part-surfaces has a direction which leads downward to the left in the drawing. At the same time, the end 22 of the magazine tape which is possibly projecting out of the drum 20 moves toward the insertion opening 16 and penetrates into it. The result of this is that the opening region of the magazine 20 approaches its end position in a direction of movement which is approximately the same as the direction of the part-surface 30. This direction is similar to the insertion direction 18. By this means, it is ensured that the projecting end 22 of the magazine strip passes correctly into the insertion opening 16. In order that the insertion opening is not blocked by one of the projections 9, the arrangement is such that in the standby position, in which one of the drum recesses 10 coincides with the advance channel 6, the drum 8 also has an open recess 10 turned toward the opening 16. A suitable latching mechanism, not illustrated, may be provided to hold the advance drum firmly in the standby position.

Figure 4:
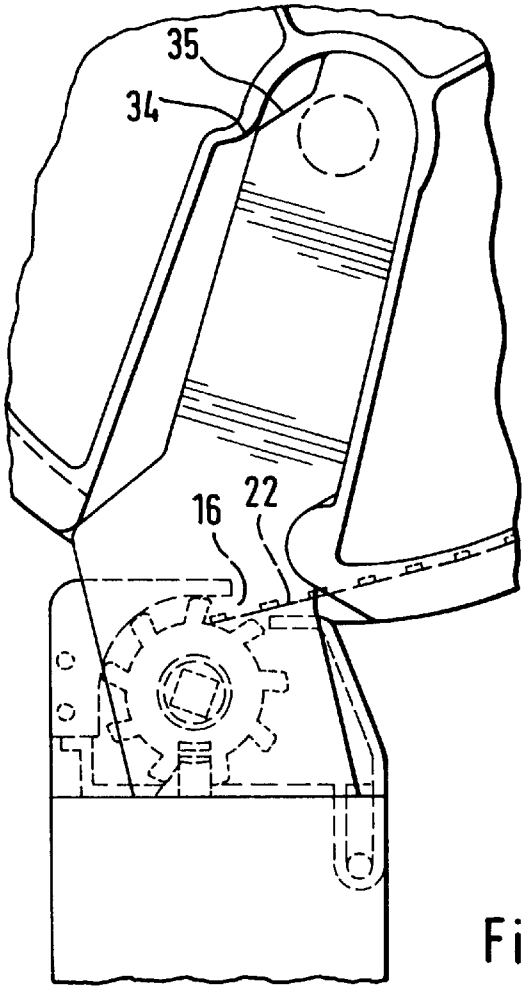

FIG. 4 shows the magazine in the end position. It can be seen that the end of the magazine strip has been placed in the drum recess 10 that is located at the insertion opening 16. In order that this happens, the end 22 of the magazine strip 21 which is projecting out of the magazine should lie within a predetermined length range, which is maintained by suitable locking means which may be of a straightforward nature and therefore need not be described. For example, provision may be made at the magazine opening for a cam or hook, which engages in a tape interspace in the magazine strip, in order to hold the latter firmly in the desired position, and which is removed when the magazine is attached to the tool. This task may also be accomplished by a simple adhesive strip.

Figure 2:
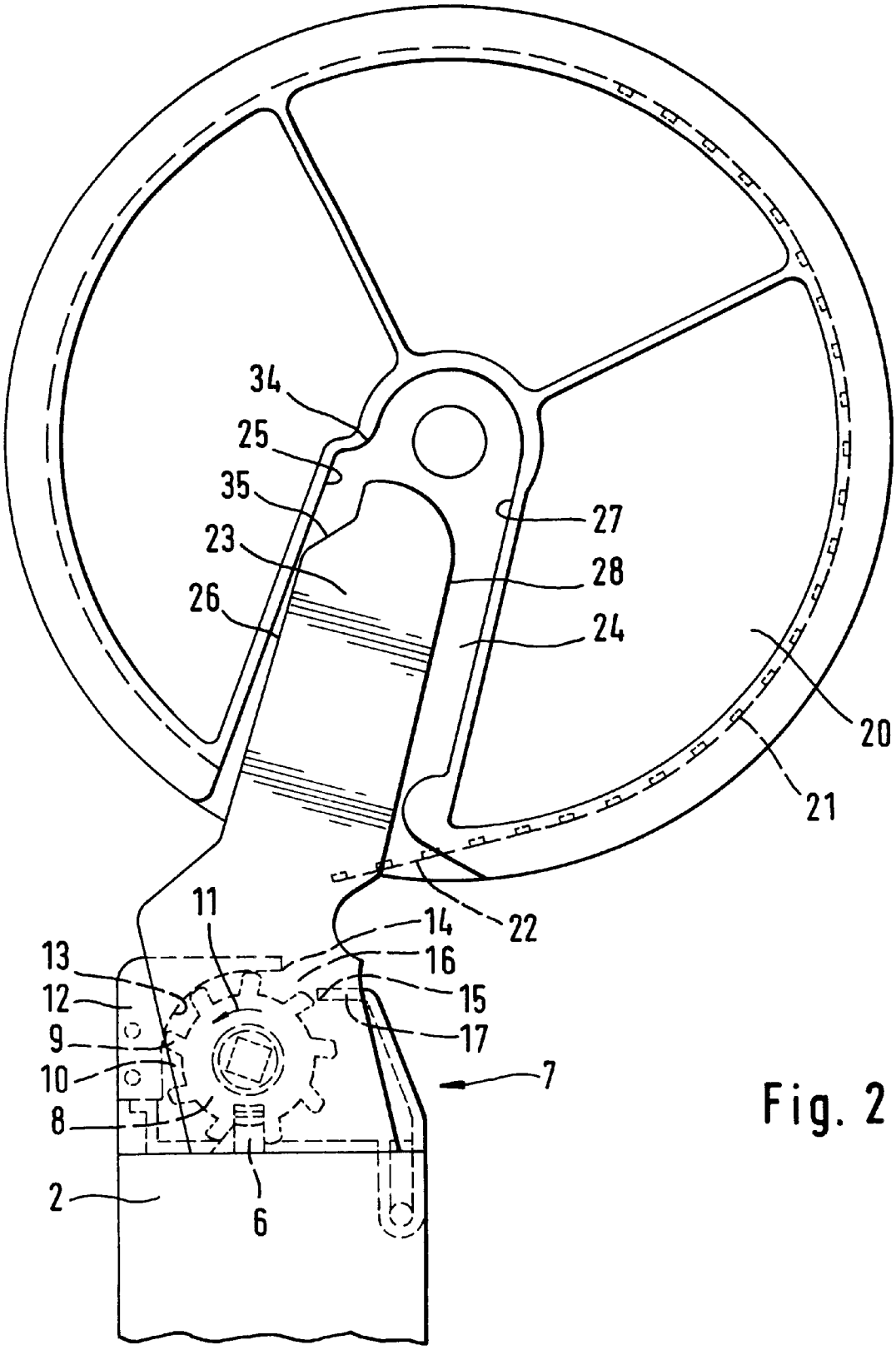
FIGS. 2 to 4 show the magazine and that part of the tool that cooperates with it in various fitting stages.
Figure 3:
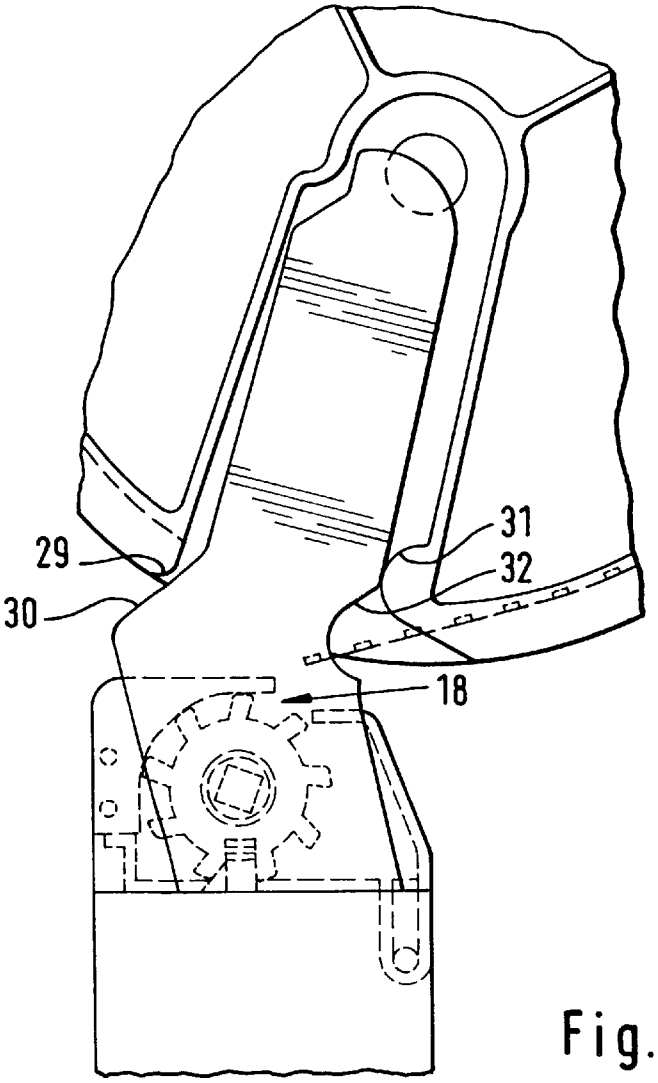

It can be seen from FIGS. 2 to 4 that the strut 23 and the receptacle 24 provided on the drum are provided, not only at their tool end but also at the other end, with part-surfaces 34, 35 which deviate from the direction of the guide surfaces 25 to 28. The part-surface 34 is designed as a rounded edge similar to the corner 29, whereas the part-surface 35 extends approximately parallel to the part-surface 30. The result of this is that as it approaches the tool, the central region of the magazine also carries out an oblique movement parallel to the movement described further above for the opening region. This is not absolutely necessary but facilitates handling.

I claim:

1. An assembly guide device for mountable connecting a magazine to a tool for tying articles by means of tapes fed along a predetermined direction to an insertion opening of the tool from an outlet opening of the magazine in the form of a magazine strip (21) having the tapes oriented alongside one another comprising cooperating mounting surfaces on both the tool and the magazine controlling movement of the magazine's outlet opening toward the tool's tape insertion opening during mounting of the magazine on the tool, said movement being along a dual-leg mounting path comprising a first leg extending toward the tool and a second leg angularly oriented relative to the first leg and extending tangentially to the insertion opening along substantially said predetermined feed direction whereby the magazine strip extending from the outlet opening passes tangentially through the insertion opening of the tool as the magazine is moved along the second path leg.

2. The tool as claimed in claim 1, wherein the direction in which the end of the magazine tape projects out of the outlet opening of the magazine is approximately the same as the feed direction (18).

3. The guide device as claimed in claim 1, wherein the magazine (20) is a circular drum, from which the end (22) of the magazine strip (21) emerges approximately tangentially.

4. The guide device as claimed in claim 1, wherein, said cooperating mounting surfaces include cam surface portions that extend approximately in the direction of said second path leg.

5. The guide device as claimed in claim 3, wherein the first path leg extends essentially radially with respect to the magazine (20).

6. The guide device as claimed in claim 1, wherein the tool contains a pulling-in drum (8) having a plurality of tape-receptacles (10) sequentially movable to a ready-to-feed position spaced from the insertion opening (16).

7. The guide device as claimed in claim 6, wherein the pulling-in drum (8) is arranged in such a way that the feed direction (18) extends approximately tangentially to said drum.

8. The guide device as claimed in claim 1, wherein at least one of said tool and magazine have a mounting receptacle and the other of said tool and magazine have a strut for insertion into said receptacle, said cooperating mounting surfaces being carried by said receptacle and said strut.

9. The guide device as claimed in claim 1 wherein the magazine is an elongated member extending longitudinally of the tool when mounted thereon and said cooperating mounting surfaces are located at both ends of the magazine.

* * * * *